US007230199B2

(12) United States Patent
Chou et al.

(10) Patent No.: US 7,230,199 B2
(45) Date of Patent: Jun. 12, 2007

(54) MULTI-STAGE BUTTON SWITCH

(75) Inventors: Chin-Wen Chou, Taipei Hsien (TW); Hong-Yi Lee, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/206,741

(22) Filed: Aug. 19, 2005

(65) Prior Publication Data

US 2007/0039810 A1 Feb. 22, 2007

(51) Int. Cl.
*H01H 13/56* (2006.01)
*E05B 15/02* (2006.01)

(52) U.S. Cl. ..... 200/523; 292/341.15; 200/524

(58) Field of Classification Search ..... 200/17 R, 200/52 R, 61.58 R, 519, 520, 523–526, 282, 200/329, 341; 292/19, 45, 336.3, 341.15, 292/341.17, 304

See application file for complete search history.

(56) References Cited

U.S. PATENT DOCUMENTS 3,624,328 A * 11/1971 Hansen ..... 200/524
3,914,570 A * 10/1975 Lockard ..... 200/524
4,161,637 A * 7/1979 Priesemuth ..... 200/524
4,660,871 A * 4/1987 Arakawa et al. ..... 292/81
4,661,667 A * 4/1987 Sorimachi et al. ..... 200/314
5,292,158 A * 3/1994 Kurosaki ..... 292/45
5,401,067 A * 3/1995 Kurosaki et al. ..... 292/63
5,775,748 A * 7/1998 Kurachi ..... 292/341.15
6,518,529 B2 * 2/2003 Bonn et al. ..... 200/520
6,759,615 B2 * 7/2004 Yamaguchi et al. ..... 200/523
6,818,848 B2 * 11/2004 Yu ..... 200/523
6,986,535 B2 * 1/2006 Kawamoto et al. .... 292/341.15

FOREIGN PATENT DOCUMENTS

TW 221884 3/1994
TW 568197 12/2003

* cited by examiner

*Primary Examiner*—Michael A. Friedhofer
(74) *Attorney, Agent, or Firm*—Birch, Stewart, Kolasch & Birch, LLP

(57) ABSTRACT

A multi-stage button switch includes a body, an elastic element and a compression element. The compression element has an integrated flexible harness arm. The body has a track zone and a harness portion which is formed with a selected geometric shape to define the moving path of the compression element that includes a start position, a first stage compression position, a compressed position and a second stage compression position in this order. The button switch thus formed consists of fewer elements, is simply structured and can be fabricated and assembled easily.

14 Claims, 10 Drawing Sheets

MULTI-STAGE BUTTON SWITCH

FIELD OF THE INVENTION

The present invention relates to a multi-stage button switch and particularly to a multi-stage button switch which has a compression element formed with an integrated harness arm.

BACKGROUND OF THE INVENTION

The multi-stage button switch, in addition to providing the function of a general button switch, also can function as a clip to provide clipping function through an upper portion and a lower portion that form a clipping zone. The clip basically functions by coupling two elements together, or releasing one element through a simple operation. It usually is used on doors, windows and the like. For instance, the door of general electric appliances has a clip. The conventional clips have many types and operate in different ways. The most widely used operation approach is compression. Such an operation includes two stages: A first compression is to couple two elements, and a second compression is to release one of the elements. A desirable clip must be operated simply, offers definite actions and not loosen off easily. The structural design of the elements of the clip directly affects its functionality.

R.O.C. Patent Publication No. 568197 entitled "Clip" discloses a clip which has an anchor seat with a housing trough holding a sliding dock which is movable between an upper and a lower detent positions. The upper side of the bottom of the housing trough and the lower surface of the sliding dock have a turnable action bar and a spring extendable upwards. The sliding dock can be compressed twice in the housing trough to form an upper and a lower anchor positions. The action bar pivotally coupled on the bottom of the anchor seat is elastic and deformable. The upper side of the action bar has two opposing and suspending ends. The two ends are located on the surface of two sides of an action plate of the sliding dock. The action plate has bosses on two sides. The two ends can slide and anchor between the bosses. By the elastic driving of the spring, the sliding dock can slide up and down in the housing trough to provide compression operation to function as a clip.

R.O.C. Patent Publication No. 221884 entitled "Improved clip" discloses a clip which has a compression portion and a housing portion. The compression portion is formed in T-shape and has a square compression surface on the top mating the housing portion. The compression surface has an indented dimple in the center. The compression portion is coupled with a upright and elastic anchor seat. The elastic anchor seat has a round hole running through the front and rear surfaces. There are two longitudinal notches on the left side and right side of the lower side of the round hole. Between the two notches, there is an elastic anchor member extended from the lower side. The elastic anchor seat has a spring on the bottom. The holding portion has a threading hole on the front side and rear side and an anchor hole on an upper side to hold the elastic anchor seat to slide up and down. The anchor hole has a square opening on the front edge and rear edge. The compression portion has a small anchor button above the round hole of the elastic anchor seat. The square opening of the holding portion has an anchor notch abutting one side running and running through an inner side of the anchor hole. The compression portion may be compressed downward and tilted. The small anchor button can be latched on the anchor notch so that the round hole and the threading hole of the compression portion and the holding portion mate each other to thread a rope.

SUMMARY OF THE INVENTION

The primary object of the present invention is to provide a simply structured multi-stage button switch. According to an embodiment of the invention, the button switch includes a body which has a housing space, an elastic element to receive forces and store a returning elastic force, and a compression element coupled with the elastic element and movable up and down in the housing space. The compression element is formed with an integrated flexible harness arm. The body has a track zone and a harness portion formed in a desired geometric shape to define a moving path of the compression element that includes a start position, a first stage compression position, a compressed position and a second stage compression position. In another embodiment, the compression element has a lower portion to couple with the elastic element and an upper portion coupled with the lower portion. The lower portion and the upper portion form an open condition at the start position. The lower portion and the upper portion form a closed condition at the compressed position to form a clipping zone. By means of the aforesaid structure, the multi-stage button switch of the invention can be formed with fewer elements, provide definite actions, and is easier to fabricate and assemble.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
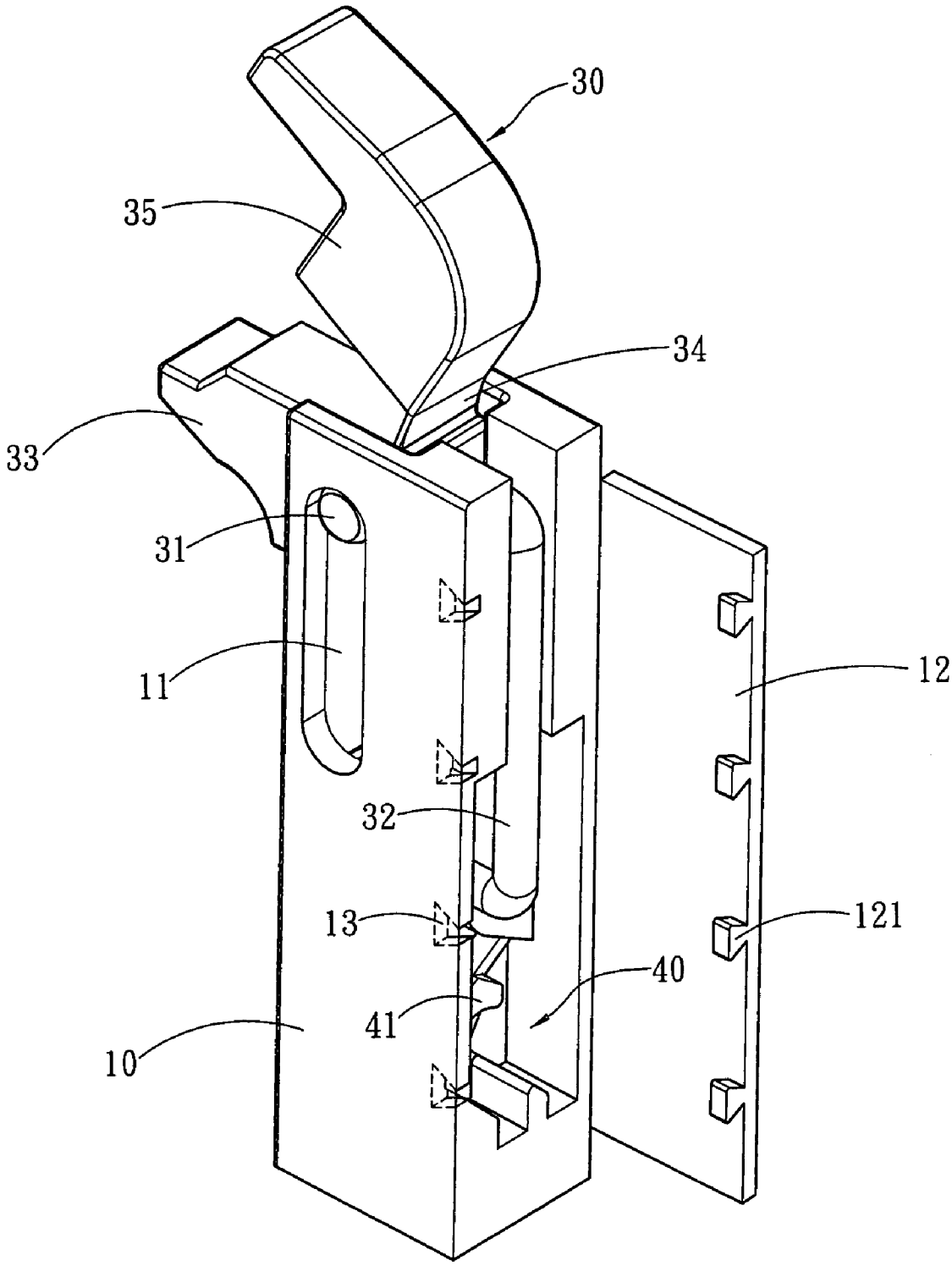
FIG. 1 is a perspective view of an embodiment of the present invention.
Figure 2:
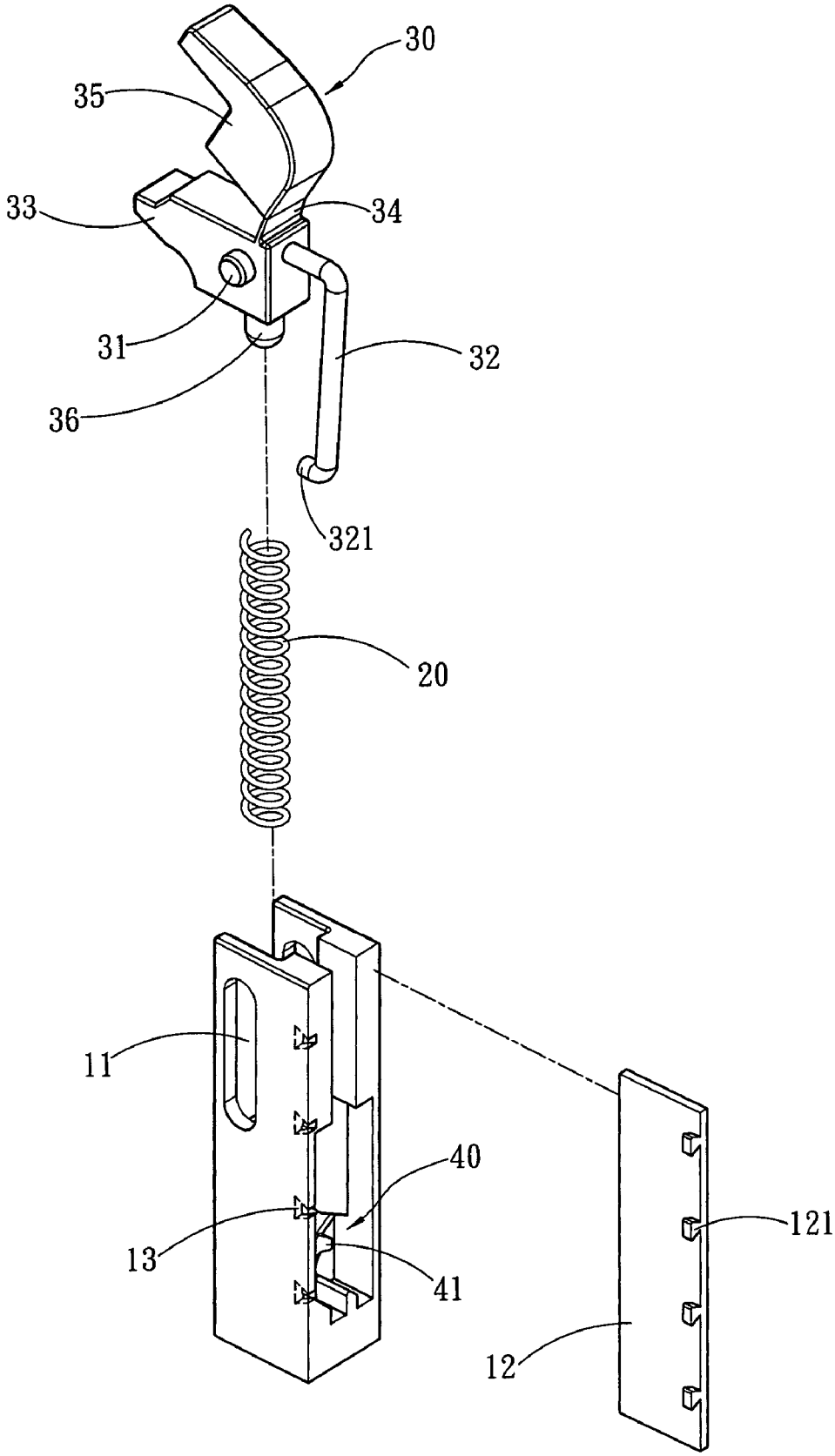
FIG. 2 is an exploded view of an embodiment of the present invention.
Figure 3A:
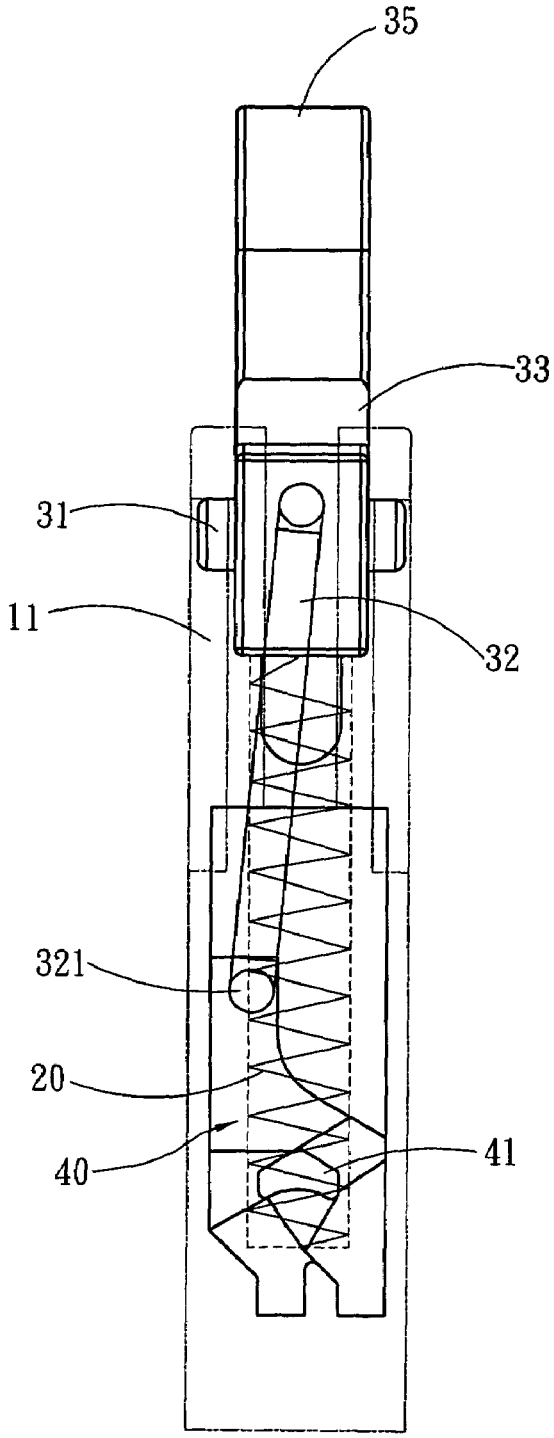
FIGS. 3A through 3E are schematic views an embodiment of the present invention in consecutive operating conditions.
Figure 3B:
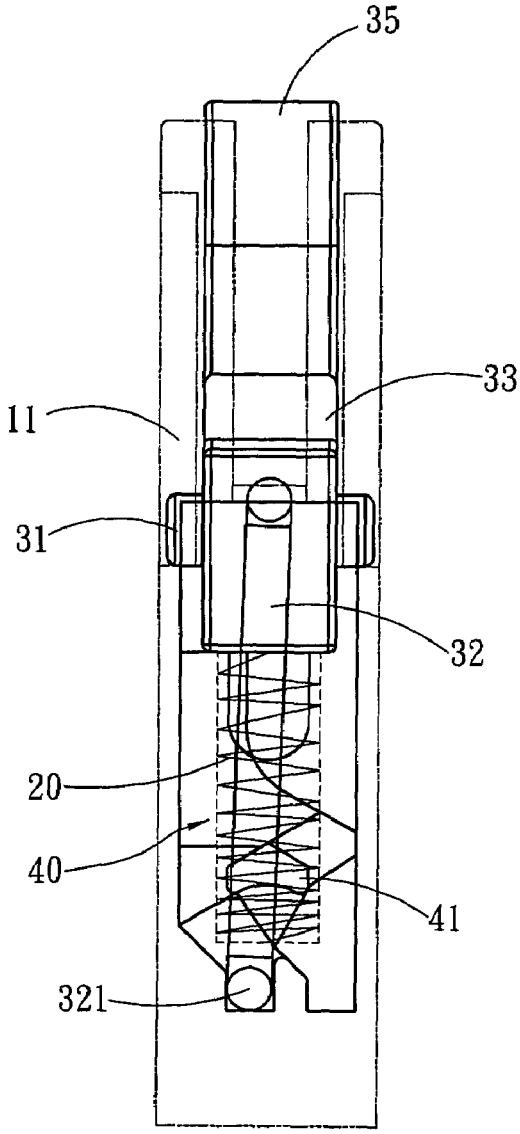
Figure 3C:
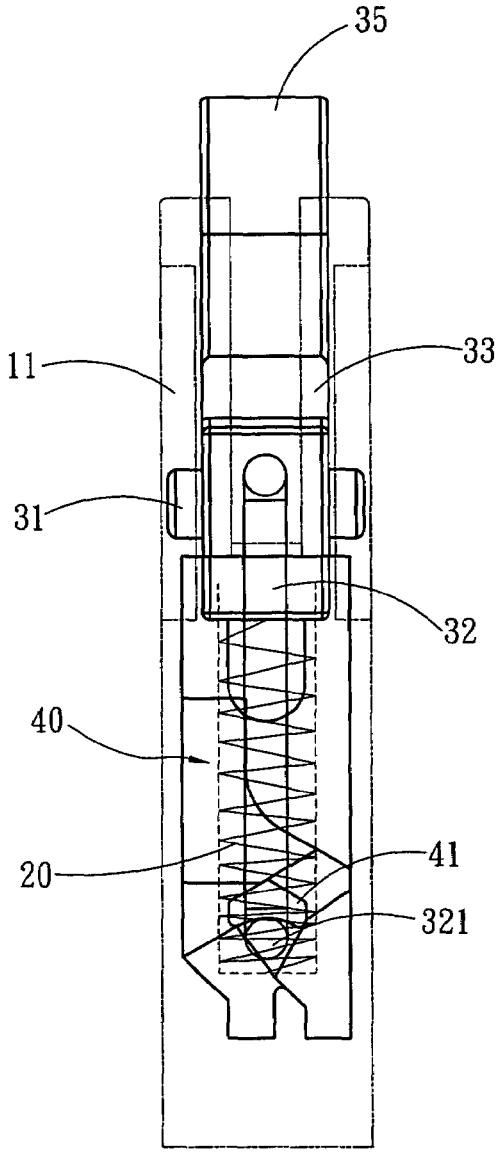
Figure 3D:
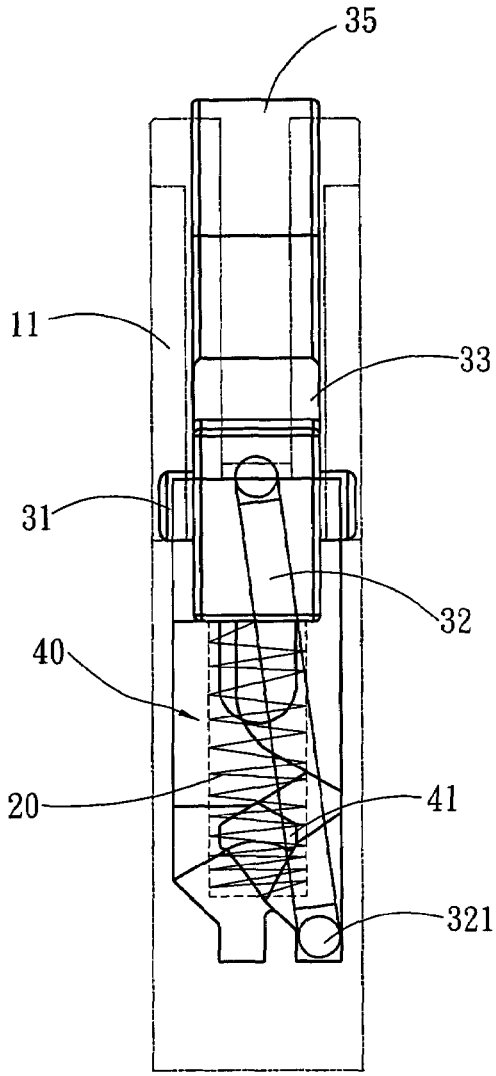
Figure 3E:
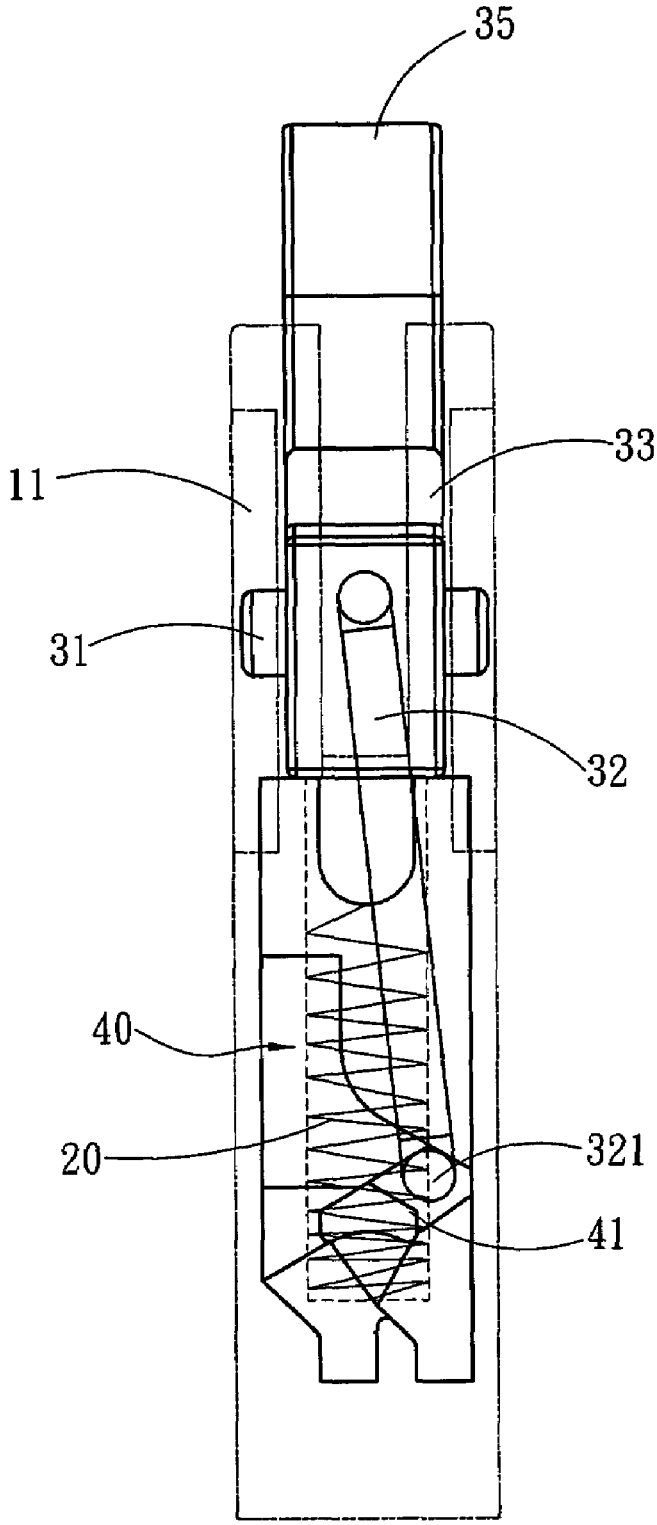

Please refer to FIGS. 1 and 2 for an embodiment of the invention. It includes a body 10, an elastic element 20 and a compression element 30. The body 10 has a housing space to hold the elastic element 20 which can receive forces and store a returning elastic force. The compression element 30 is coupled with the elastic element 20 and movable up and down in the housing space. The compression element 30 has an anchor portion 36 to couple with the elastic element 20. The body 10 has slots 11 on two side walls abutting the housing space that are corresponding to guiding stubs 31 formed on two sides of the compression element 30. The compression element 30 can slide in the housing space through the guiding stubs 31 and the slots 11. The compression element 30 is integrally formed with a flexible harness arm 32. The body 10 also has a track zone 40 to accommodate the moving path of the harness arm 32 corresponding to the up and down displacement of the compression element 30. The track zone 40 has a harness portion 41 which is located in a jutting manner in the track zone 40 at a selected height. The harness arm 32 has a retaining end 321 corresponding to the height and confined by the harness portion 41. The body 10 has an open surface on one side where the track zone 40 is formed. The open surface is covered by a lid 12. The lid 12 and the body 10 have corresponding lugs 121 and anchor notches 13.

Figure 5:
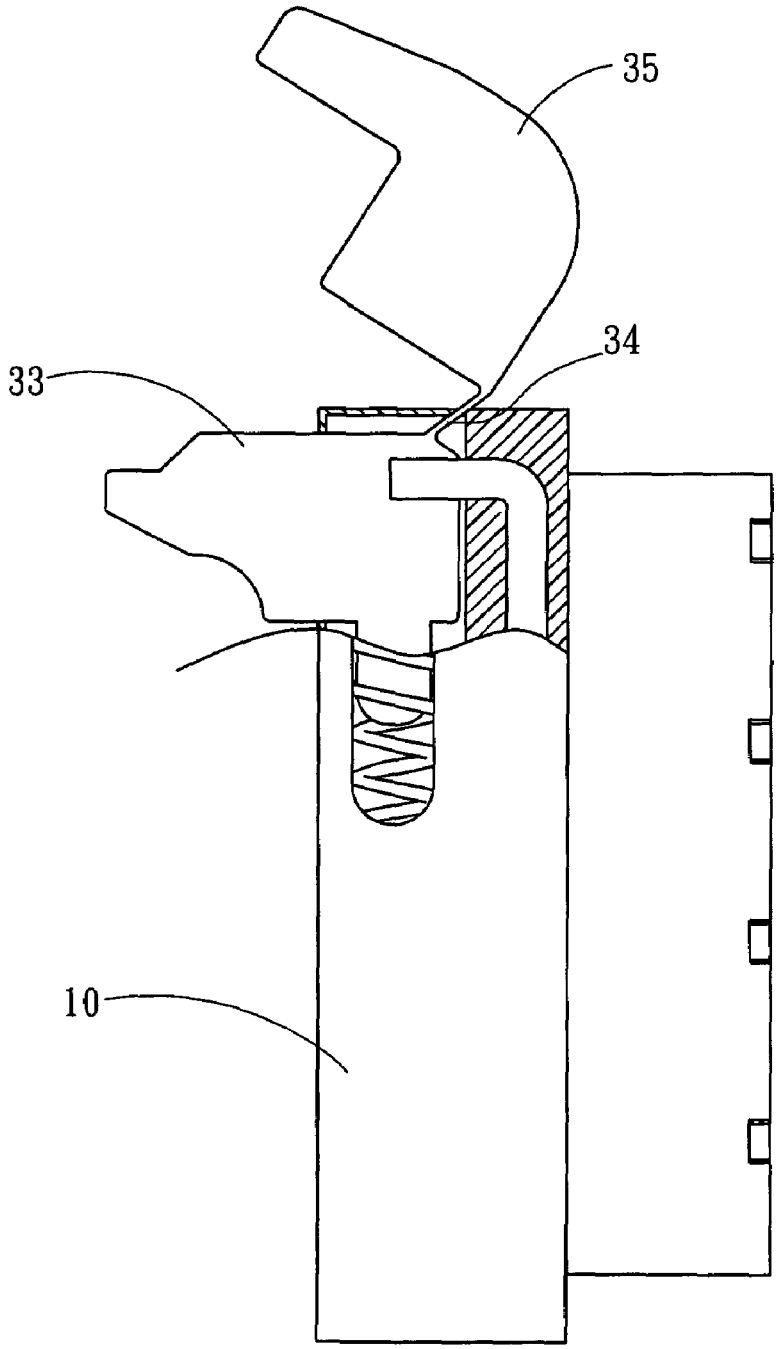
FIG. 5 is a side view of an embodiment of the present invention partly cutaway.

Refer to FIG. 5 for a side view of an embodiment of the invention. The compression element 30 has a lower portion 33 to couple with the elastic element 20. The lower portion 33 has a flexible coupling blade 34 on one end that is extended at an inclined angle. The coupling blade 34 is connected to an upper portion 35. The anchor portion 36 to couple with the elastic element 20 is located on a lower side of the lower portion 33. The lower portion 33 and the upper portion 35 are opened at a start position. When the compression element 30 is moved in the body 10, the upper portion 35 is moved close to the lower portion 33 about the coupling blade 34 to form a closed condition and a clipping zone.

Figure 4A:
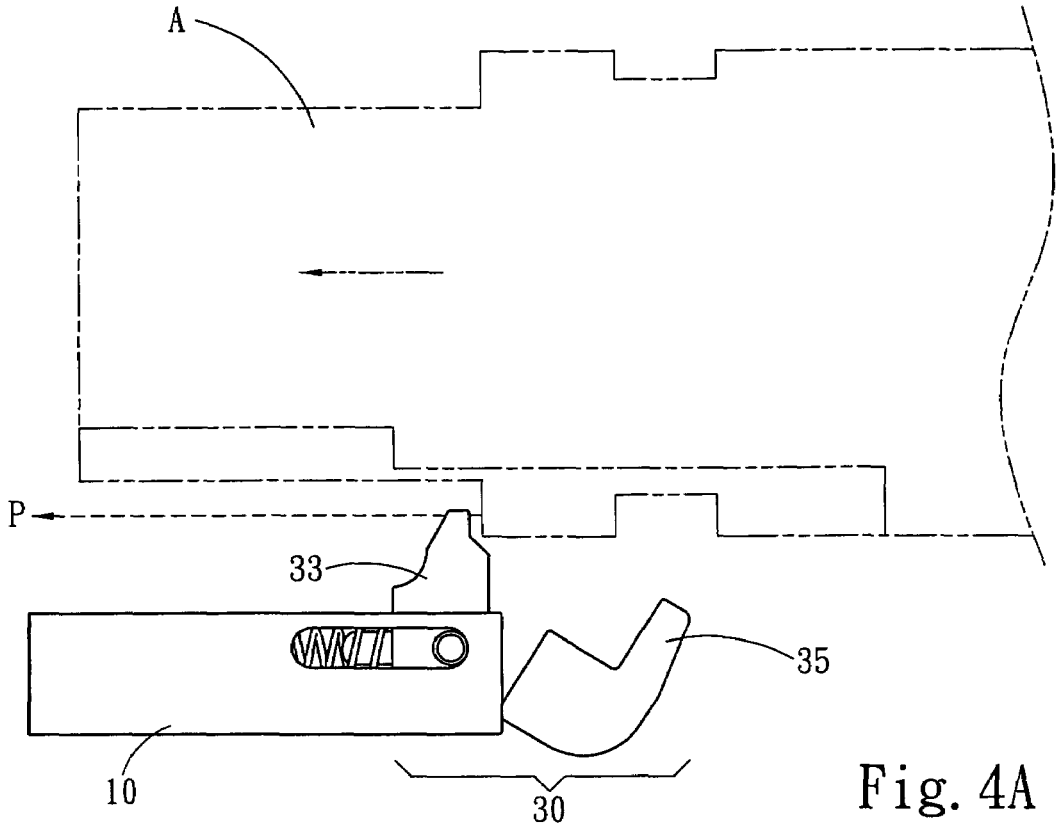
FIGS. 4A, 4B and 4C are schematic views of an embodiment of the present invention in use conditions.
Figure 4B:
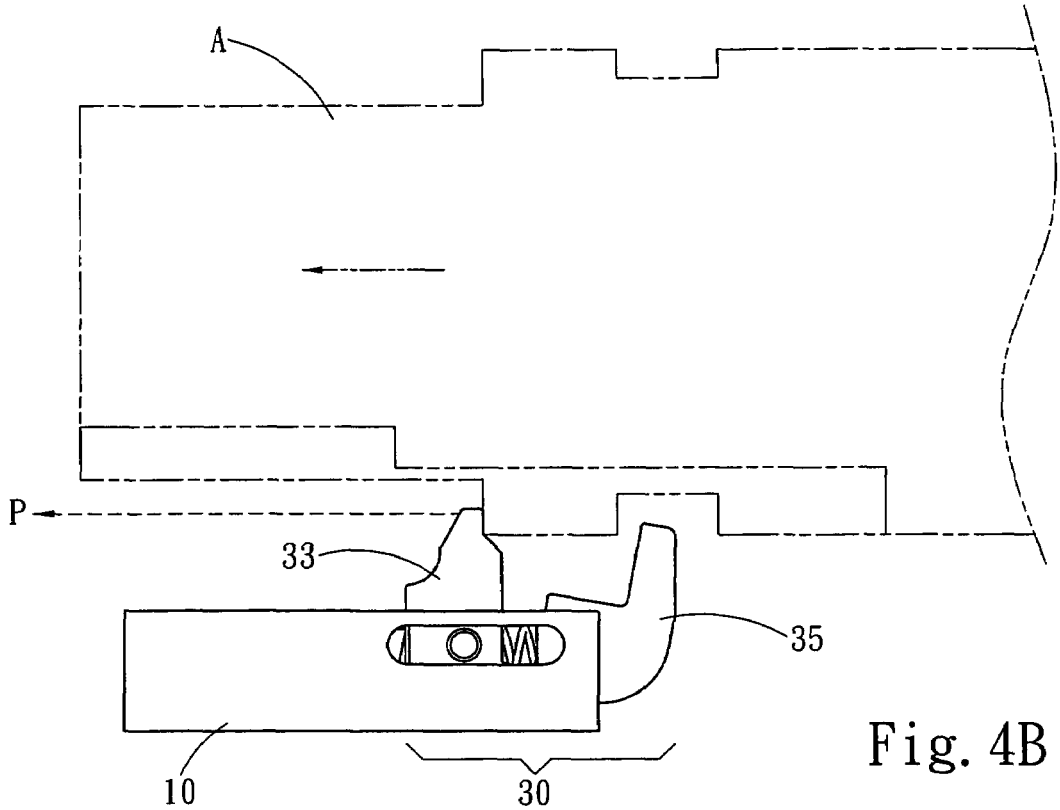
Figure 4C:
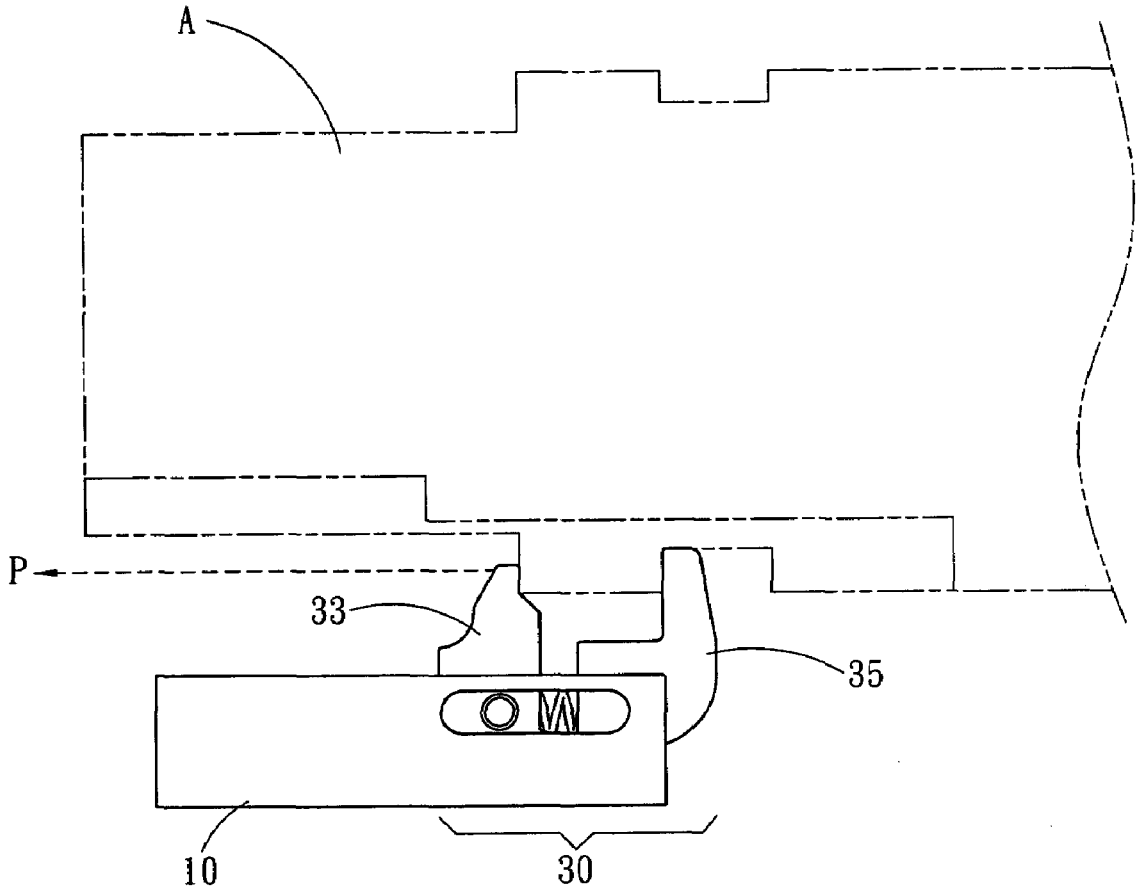

Refer to FIGS. 4A, 4B and 4C for an embodiment of the invention in use conditions. When an object A to be clipped is moved along a path P towards the compression element 30 to push the lower portion 33, the compression element 30 is moved towards the bottom of the body 10. The upper portion 35 is driven and retracted in the housing space of the body 10 and moved close to the lower portion 33 to form the closed condition and the clipping zone.

Refer to FIGS. 3A through 3E, and FIGS. 4A through 4C for the invention in consecutive operating conditions. The compression element 30 can slide in the housing space of the body 10 through the guiding stubs 31 and the slots 11. As the harness portion 41 is jutting at a selected height in the track zone 40, and the retaining end 321 of the harness arm 32 is at the corresponding height of the harness portion 41, the moving path of the compression element 30 and the harness arm 32 is defined by the retaining end 321 moving in the track zone 40 and according to the geometric shape of the harness portion 41. When the compression element 30 and the harness arm 32 are at the start position (referring to FIGS. 3A and 4A), the lower portion 33 and the upper portion 35 are open. When a force is applied and the compression element 30 and the harness arm 32 are moved towards a first stage compression position, the upper portion 35 is retracted in the body 10 and moved close to the lower portion 33 (referring to FIG. 4B) to reach the first stage compression position, and the lower portion 33 and the upper portion 35 are closed (referring to FIG. 3B). When the force is released, the compression element 30 and the harness arm 32 are moved and anchored on a compressed position via the retaining end 321 moving according to the geometric shape of the harness portion 41 and due to driving of the elastic element 20 (referring to FIGS. 3C and 4C). The lower portion 33 and the upper portion 35 are closed to form the clipping zone. When another force is applied on the compression element 30 and the harness arm 32 again, they are moved away from the compressed position to a second stage compression position (referring to FIG. 3D). When the another force is released, the retaining end 321 is moved according to the geometric shape of the harness portion 41, and the compression element 30 is driven by the elastic element 20 to move towards the start position. The upper portion 35 slides outside the body 10 and moves away from the lower portion 33 (referring to FIG. 3E).

Figure 6:
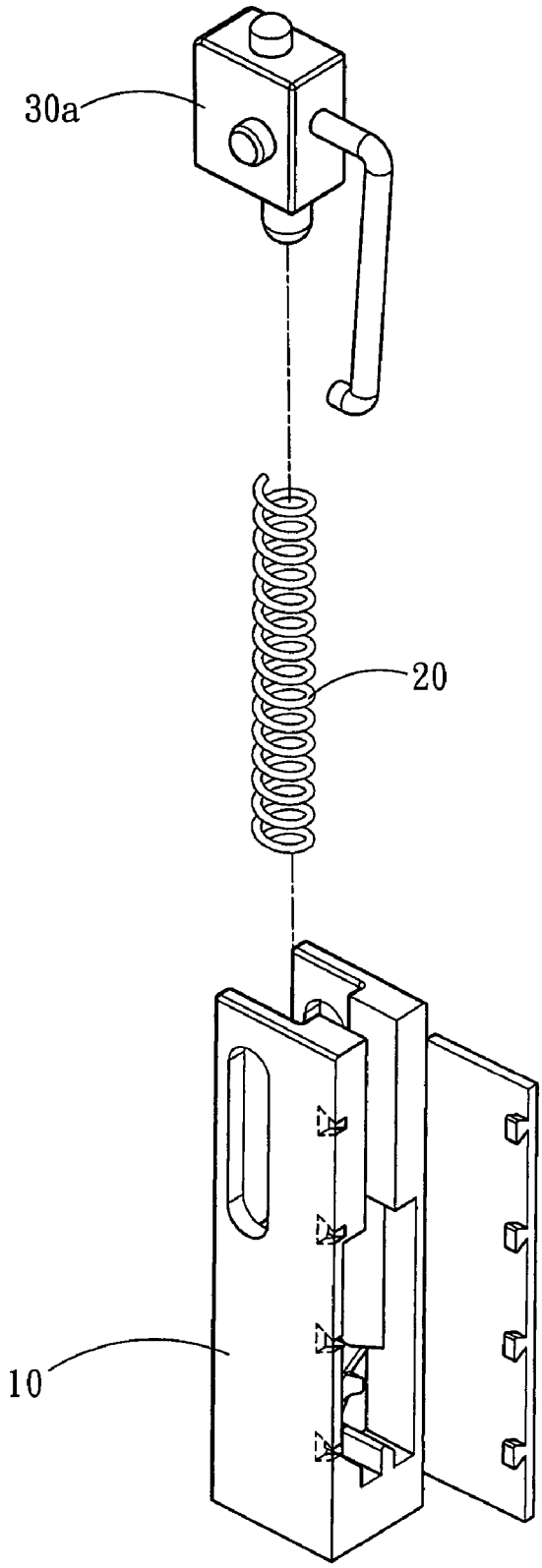
FIG. 6 is an exploded view of another embodiment of the present invention.

Refer to FIG. 6 for another embodiment of the invention. The compression element 30*a* may be a switch button.

Figure 7:
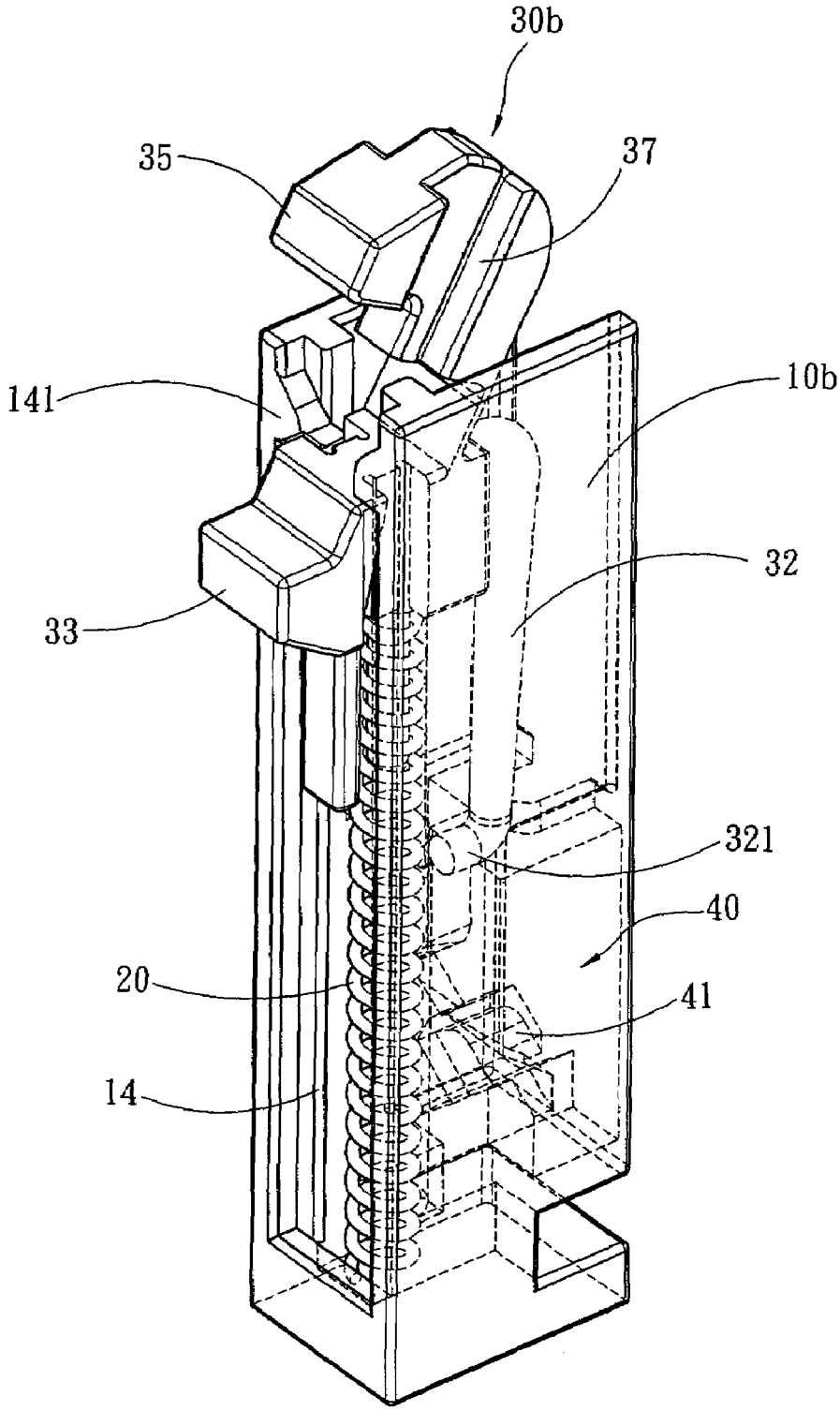
FIG. 7 is a perspective view of yet another embodiment of the present invention.

Refer to FIG. 7 for yet another embodiment of the invention. It is largely constructed like the one previously discussed. However, the body 10*b* has an open surface to allow the compression element 30*b* to be moved up and down. There is a sliding track 14 on the open surface of the body 10*b* and a corresponding guiding flute 37 on a lateral side of the compression element 30*b*. The sliding track 14 has a detent portion 141 on an upper end to stop the lower portion 33. Thus the compression element 30*b* is movable up and down in the housing space of the body 10*b* through the guiding flute 37 and the sliding track 14. The detent portion 141 can stop the upper edge of the lower portion 33 to prevent the compression element 30*b* from escaping the housing space of the body 10*b*.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A multi-stage button switch, comprising a body which has a housing space, an elastic element located in the housing space to receive forces and store a returning elastic force, and a compression element which is located in the body and coupled with the elastic element and movable up and down in the housing space;

wherein the compression element has an integrated flexible harness arm, the body having a track zone corresponding to a moving path of the harness arm according to the up and down movement of the compression element, the track zone having a harness portion, the moving path of the compression element and the harness arm being defined by the track zone and the geometric shape of the harness portion that includes a start position, a first stage compression position, a compressed position and a second stage compression position in this order.

2. The multi-stage button switch of claim 1, wherein the compression element is a switch button.

3. The multi-stage button switch of claim 1, wherein the compression element has a lower portion to couple with the elastic element and an upper portion connecting to the lower portion, the lower portion and the upper portion being in an open condition at the start position, and in a closed condition at the compressed position to form a clipping zone.

4. The multi-stage button switch of claim 3, wherein the lower portion and the upper portion are connected through an integrated flexible coupling blade which is extended from one end of the lower portion at an inclined angle.

5. The multi-stage button switch of claim 3, wherein the body has an open surface for the compression element to be moved up and down, the open surface having a sliding track and the compression element has a guiding flute on one side corresponding to the sliding tack, the sliding track having a detent portion on an upper end to stop the lower portion.

6. The multi-stage button switch of claim 1, wherein the compression element has an anchor portion to couple with the elastic element.

7. The multi-stage button switch of claim 1, wherein the housing space has side walls which have respectively a slot and the compression element has a guiding stub on each of two sides corresponding to the slot.

8. The multi-stage button switch of claim 1, wherein the harness portion is jutting in the track zone at a selected height, the harness arm having a retaining end corresponding to the height and confined by the harness portion.

9. The multi-stage button switch of claim 1, wherein the body has an open surface on one side where the track zone is formed to be covered by a lid.

10. The multi-stage button switch of claim 9, wherein the lid and the body have respectively anchor lugs and anchor notches that correspond to each other.

11. The multi-stage button switch of claim 1, wherein the compression element has an upper portion and a lower portion, the upper portion being movable toward and away from the lower portion and being connected by a flexible coupling blade extending therebetween, the lower portion being connected to the elastic element and when moved away from the start position, the lower portion moves the flexible coupling blade to pull the upper portion to a closed clipping position.

12. The multi-stage button switch of claim 11, wherein the upper portion, the lower portion and the flexible coupling blade are a single unitary, one-piece structure.

13. The multi-stage button switch of claim 1, wherein the flexible harness arm extends away from the compression element toward the harness portion, the compression element being located in a top portion of the housing and the harness position being located toward a bottom portion of the housing.

14. The multi-stage button switch of claim 13, wherein the compression element has an upper portion and a lower portion which are pivotable about a first axis and wherein the flexible harness arm is pivotable on the compression element about a second axis, the first and second axes being perpendicular to one another.

* * * * *